US005387901A

United States Patent [19]

Hardt

[11] Patent Number: 5,387,901

[45] Date of Patent: Feb. 7, 1995

[54] LED INDICATING LIGHT ASSEMBLY FOR A COMPUTER HOUSING

[75] Inventor: Thomas T. Hardt, Missouri City, Tex.

[73] Assignee: Compaq Computer Corporation, Houston, Tex.

[21] Appl. No.: 988,723

[22] Filed: Dec. 10, 1992

[51] Int. Cl.[6] ..... G09G 3/14

[52] U.S. Cl. ..... 340/815.42; 340/815.45; 313/117; 362/307; 362/800

[58] Field of Search ..... 340/757, 815.31, 815.4, 340/815.42, 815.45; 313/110, 111, 117, 512; 437/906, 206; 362/26, 27, 31, 238, 244, 249, 800, 293, 307; 385/129, 146; 359/362, 503; 250/227.28

[56] References Cited

U.S. PATENT DOCUMENTS

| | | | |
|---|---|---|---|
| Re. 34,254 | 5/1993 | Dragoon | 362/800 |
| 4,535,396 | 8/1985 | Guthrie | 362/27 |
| 4,941,072 | 7/1990 | Yasumoto et al. | 362/800 |
| 4,941,734 | 7/1990 | Williams et al. | 250/227.28 |

*Primary Examiner*—Richard Hjerpe
*Assistant Examiner*—Walter J. Malinowski
*Attorney, Agent, or Firm*—Konneker Bush Hitt & Chwang

[57] ABSTRACT

An LED indicating light assembly is mounted on the interior side of a computer housing wall, over a lens opening therein, and is operative to provide a visual confirmation that an operating component within the computer housing is activated. The assembly includes a mounting socket structure having an open front end securable to the housing wall over the lens opening, and an open rear end. An elongated lens member is longitudinally inserted forwardly into the socket structure to position a front end portion of the lens in the housing wall lens opening. As the lens is inserted into the socket structure, a transverse mounting pin portion of the lens, intermediate its front and rear ends, is latched into place by a resiliently deflectable outer side wall portion of the socket structure. An LED device positioned behind the mounted lens is used to illuminate its front end portion. A multiple lens embodiment of the socket structure receives and lockingly engages two closely adjacent rows of lenses with the rear ends of the lenses being laterally offset from their front ends in a manner providing increased rear mounting space for the LED devices used to illuminate the lenses.

10 Claims, 3 Drawing Sheets

LED INDICATING LIGHT ASSEMBLY FOR A COMPUTER HOUSING

BACKGROUND OF THE INVENTION

1. Field of the Invention

The present invention generally relates to LED indicating light apparatus, and more particularly relates to LED lenses and associated apparatus for mounting the lenses on a housing structure such as a computer housing.

2. Description of Related Art

Housing portions of computers are typically provided with one or more indicating lights to provide the computer operator with a visual indication that certain computer operating components, such as hard disk drives, are running. A common indicating light construction for this application comprises a lens structure supported within the housing and projecting outwardly through an opening therein, and an LED (light emitting diode) device supported behind the lens and operative to periodically illuminate it.

Various methods have previously been proposed for operatively mounting the lens at the housing lens opening. For example, one conventional lens mounting method is performed by forming a recess in the inner side surface of the housing surrounding a lens opening therein. The lens to be mounted has a central portion configured to extend outwardly through the housing opening and an enlarged peripheral shoulder portion sized to fit within the housing surface recess. To install the lens, its central portion is extended outwardly through the housing opening, and its shoulder portion is glued or sonically welded within the housing recess.

While this lens mounting technique appears to be a rather simple and straightforward one, it presents several well known problems, limitations and disadvantages. For example, the gluing or sonic welding process needed to carry out the lens mounting tends to be a tedious and rather time-consuming task.

Moreover, the required shoulder structure surrounding the central lens portion as a practical matter precludes the close grouping of a series of indicating lights on the housing, each central lens portion in a multiple lens array being spaced apart from an adjacent central portion of each other lens by a minimum distance equal to twice the width of their mounting shoulders. Another general limitation associated with this conventional lens mounting technique is that when multiple lenses are to be mounted in even a relatively closely grouped array, some type of light shield structure must be provided to prevent the LED associated with one lens from illuminating one or more of the other lenses.

Another prior art technique for mounting LED indicating light lenses on computer housings over lens openings therein is to mold a pair of clip structures on opposite sides of each lens opening, the clip structures projecting into the housing from the inside surface thereof and being configured to snap outwardly over the light-receiving end of the lens. This method provides for a quicker and easier mounting of the lens, but still tends to preclude the mounting of a series of lenses in a tightly spaced array. Additionally, since the outer ends of each clip pair extend across portions of the light-receiving end of their associated lens, a pair of dark spots are undesirably present on the illuminated lens, such dark spots being caused by the outer end portions of the clip members blocking a portion of the LED light being beamed on to the inlet end of the lens.

It can be readily seen from the foregoing that a need exists for improved LED lens/mounting structure apparatus that eliminates or at least substantially reduces the above-mentioned problems, limitations and disadvantages commonly associated with conventional LED lenses and their associated housing mounting structures. It is accordingly an object of the present invention to provide such improved apparatus.

SUMMARY OF THE INVENTION

In carrying out principles of the present invention, in accordance with a preferred embodiment thereof, a specially designed LED indicating light assembly is provided for use in visually indicating the activation of an operating component disposed within, for example, a computer housing.

In a single light embodiment thereof, the assembly includes an LED lens member and a mounting socket structure for receiving and operatively supporting the lens member on the interior side of an exterior side wall structure portion of the housing over a lens opening therein.

The lens member is preferably molded from a plastic material and has an elongated body having a front end portion receivable in the lens opening, a rear end portion positionable in an opposing relationship with an LED device to receive light emitted therefrom. The lens member is operative to pass the received light longitudinally to the outer face of its front end portion along an internal light transmission path externally bounded by a peripheral outer side surface of the lens member. Extending transversely outwardly from a longitudinally intermediate portion of the peripheral outer side surface is a mounting projection.

The mounting socket structure is preferably molded from a plastic material and has an open front end securable to the interior side of the housing side wall structure over the lens opening therein, and an open rear end adjacent to which an LED device may be operatively positioned. An outer side wall portion of the mounting socket structure is configured to define resilient latch means operative to lockingly engage the lens member mounting projection in response to forward insertion of the lens member through the interior of the socket structure to an operating position in which the front end portion of the lens member is outwardly received in the housing side wall structure lens opening.

Because the inserted lens member is locked in place within the socket structure at a longitudinally intermediate exterior side portion of the lens member, the prior art problem of dark spots appearing on the illuminated front lens end portion, caused by support structure encroachment along its rear end, is desirably eliminated. Additionally, due to the simple "snap-in" method used to operatively support the lens, the prior art necessity of gluing or sonically welding the lens in place is also advantageously eliminated.

In a multiple light embodiment of the indicating light assembly, the mounting socket structure is internally divided into two closely spaced parallel rows of open-ended cavities each externally and internally configured to receive and support one of a series of LED lenses each identical in construction and configuration to the lens received and supported by the previously described single lens mounting socket structure. Outer side wall latch means portions of the multiple lens mounting socket structure partially bound each of its cavities and function to lockingly engage each of the inserted lens members in response to forward insertion of the lens member through its associated cavity to an operating position in which the front end of the inserted lens member is outwardly received in one of a series of lens openings formed in the housing side wall structure.

The multiple light embodiment of the indicating light assembly provides, for each of its LED lenses, the same advantages of the single light embodiment of the assembly, and additionally permits the illuminated front end portions of the lens members to be grouped in a closely spaced array. Additionally, a rear end portion of each socket cavity is enlarged relative to the balance of the cavity, and a rear end portion of each lens member is laterally offset relative to the balance thereof, in a manner conveniently providing increased rear end mounting space for the LED devices associated with the supported lens members.

DETAILED DESCRIPTION

Figure 1:
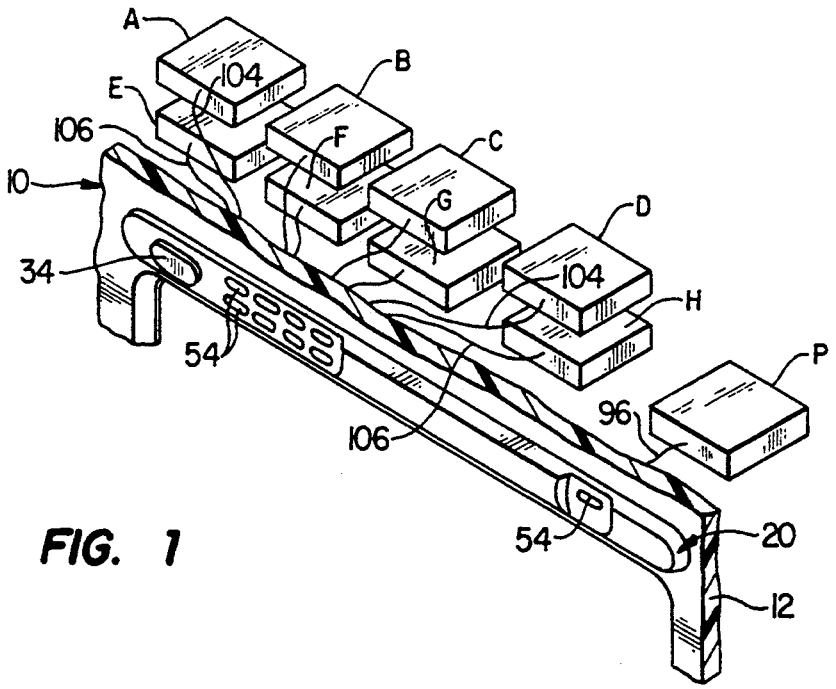
FIG. 1 is a partially schematic perspective view of a front side portion of a computer housing, representative operating components disposed inside the housing, and the visible portions of a front mounted series of LED indicating light assemblies incorporating principles of the present invention and operative to provide visual confirmation that their associated operating components are activated.
Figure 2:
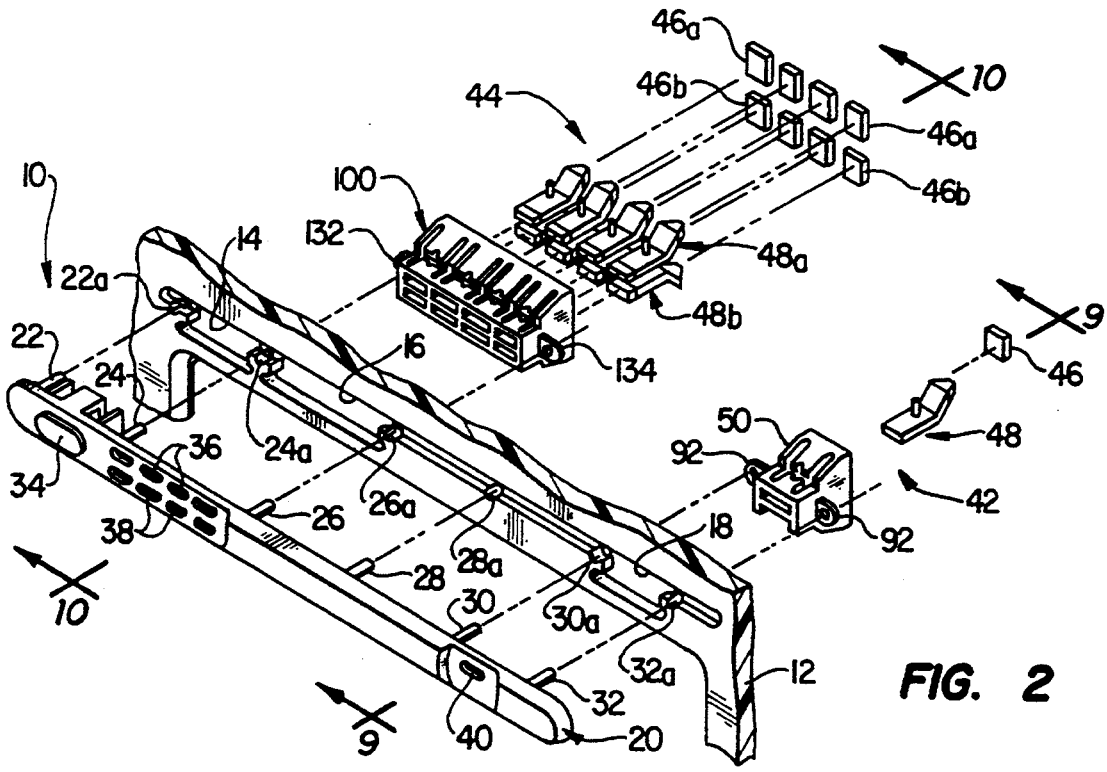
FIG. 2 is a partially exploded perspective view of the housing portion and the LED indicating light assemblies mounted thereon.

Perspectively illustrated in FIGS. 1 and 2 is a portion of a housing wall structure on the front side of a representative computer housing within which a variety of operating components, including the schematically depicted disk drives A-H and power supply circuit P, are disposed. The housing wall structure 10 includes a front housing wall 12 with spaced openings 14,16 and 18 therein, and an exterior molded plastic trim strip 20 secured to the wall 12 across the openings therein. Projecting outwardly from the back side of the trim strip 20 are, from left to right as viewed in FIG. 2, transverse mounting pins 22,24,26,28,30 and 32 which are rearwardly extended through corresponding circular holes *22a*,*24a*,*26a*,*28a*,*30a* and *32a* in housing wall 12. With these pins in place within their associated housing wall holes, the outer ends of the pins project rearwardly beyond the interior side of the housing wall 12.

Carried on the left end of the trim strip between its mounting pins 22 and 24, is a conventional drive test and reset button structure 34, a rear end portion of which is received in the housing wall opening 14. For purposes later described, an upper row of four generally oval lens receiving openings 36 (see FIG. 2) and a lower row of four generally oval lens receiving openings 38 are formed through the longitudinal portion of the trim strip 20 that extends across the wall opening 16, and a single, generally oval lens opening 40 is formed through the portion of the trim strip that extends across the wall opening 18.

The operator of the computer is provided with a visual indication that one or more of the operating components A–P have been activated by means of two specially designed LED indicating light assemblies 42 and 44 embodying principles of the present invention. Assembly 42 is a single light assembly mounted on the interior side of the wall structure 10 at the opening 18, as later described, and is operatively connected to the power supply circuit P. Assembly 44 is a multiple light assembly mounted on the interior side of the wall structure 10 at the opening 16, also as later described, and is operatively connected to the disk drives A–H.

Figure 3:
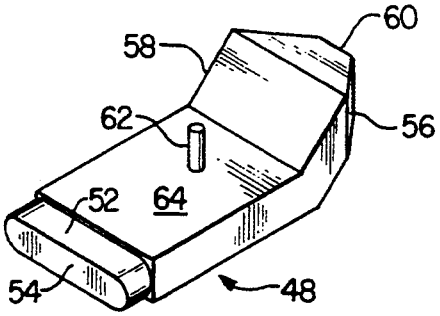
FIGS. 3 and 4, respectively, are enlarged scale front and rear end perspective views of a uniquely configured lens portion of one of the LED indicating light assemblies.
Figure 4:
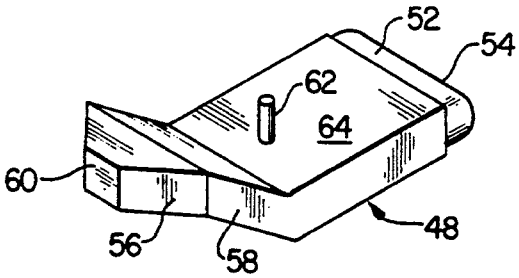

The indicating light assembly 42 is useable in conjunction with a conventional LED (light emitting diode) device 46 and includes a molded plastic lens member 48 and a molded plastic mounting socket structure 50. Referring now to FIGS. 3 and 4, the lens member 48 has an elongated body with a generally rectangular cross-section along its length; a front end portion 52 having a generally oval cross-section and a front end face 54, and being outwardly receivable in the complementarily configured lens opening 40 (FIG. 2); and a rear end portion 56 extending generally parallel to the front end portion 52 and being laterally offset from the balance of the lens body by an angled, longitudinally intermediate body portion 58.

The back end of the lens body is inwardly tapered on opposite sides thereof and terminates in an essentially planar square rear end face 60. When the LED device 46 (FIG. 2) is operatively positioned in an opposed relationship with the end face 60 as later described, light emitted from the LED device is passed forwardly through the lens body, from its rear end face 60 to its front end face 54 via an internal light transmission path bounded by the peripheral side surface of the lens body, to illuminate the front end portion 52 of the lens member 48. For purposes later described, a cylindrical mounting pin portion 62 of the lens 48 longitudinally projects outwardly from an outer side surface portion 64 thereof intermediate its front end portion 52 and its angled intermediate portion 58.

Figure 5:
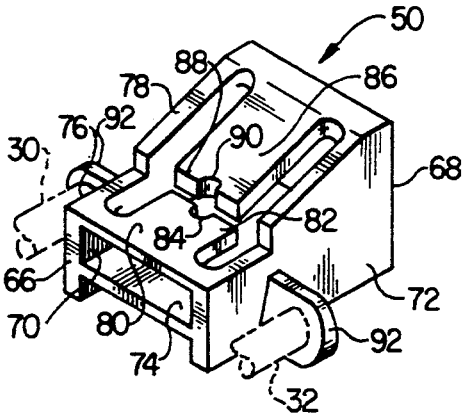
FIGS. 5 and 6, respectively, are enlarged scale front and rear end perspective views of a snap-in mounting structure used in the single LED indicating light structure illustrated in FIG. 2.
Figure 6:
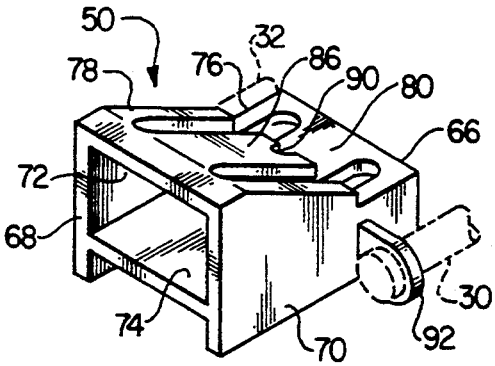
Figure 7:
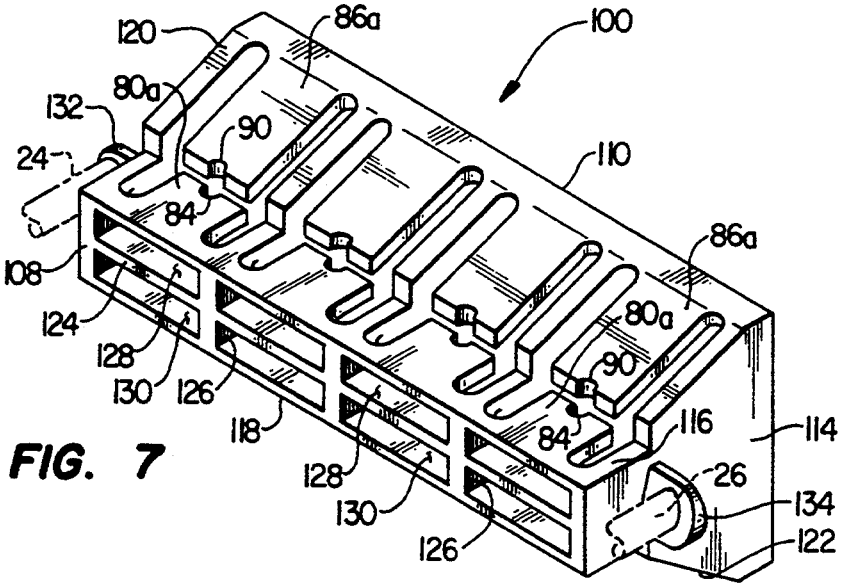
FIGS. 7 and 8, respectively, are enlarged scale front and rear end perspective views of a snap-in mounting structure used in the multiple LED indicating light structure illustrated in FIG. 2.
Figure 8:
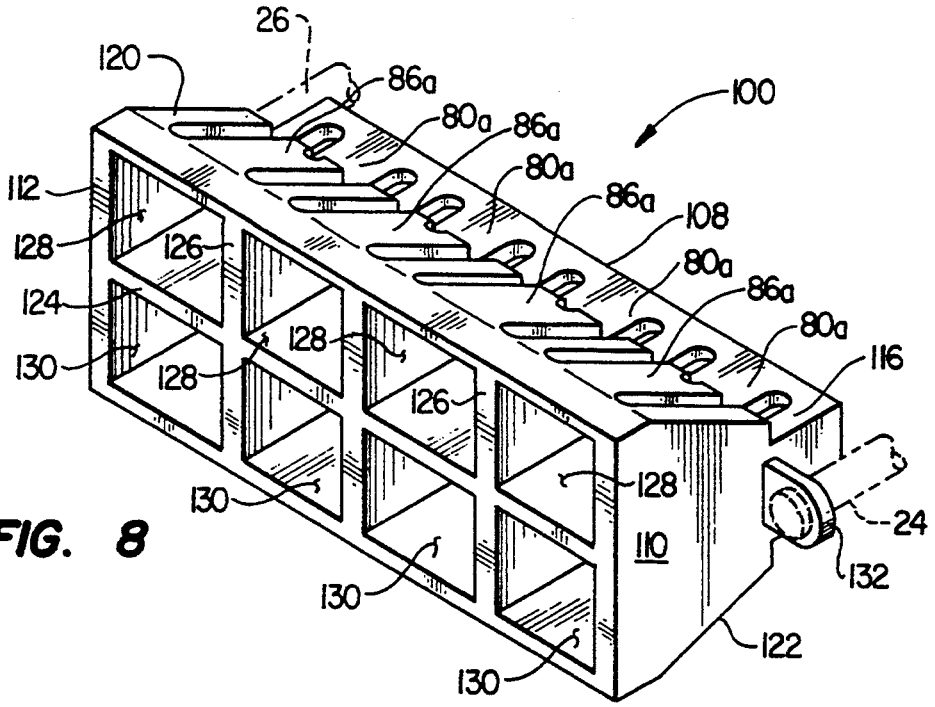

Turning now to FIGS. 5 and 6, the mounting socket structure 50 has an open front end 66, an open rear end 68, a pair of opposite vertical outer side walls 70 and 72, a bottom outer wall 74, and a top outer side wall having a horizontal front portion 76 and an upwardly and rearwardly sloped rear portion 78. The wall portion 76 is appropriately slotted to define thereon a central section 80 having a rear end surface 82 in which an arcuate depression 84 is formed. In a similar fashion, the sloping wall portion 78 is appropriately slotted to define thereon a resiliently deflectable section 86 having a front end surface 88. Front end surface 88 is positioned slightly above and to the rear of the rear end surface 82 of wall section 80. An arcuate depression 90, aligned with depression 84, is formed in the front end surface 88. As will be seen, the top outer side wall sections 80,86 function as resilient latch means for lockingly engaging the lens mounting pin 62 to operatively hold the lens member 48 within the interior of the mounting socket structure 50.

Figure 9:
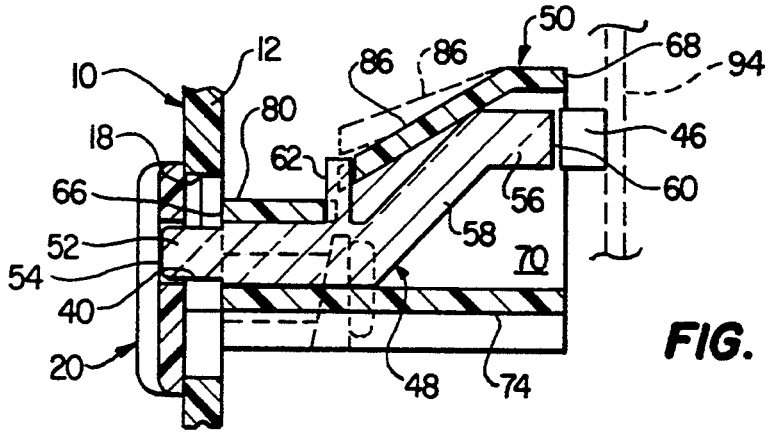
FIG. 9 is an enlarged scale cross-sectional view, taken along line 9—9 of FIG. 2, through the single lens LED indicating light assembly illustrating it in an assembled state.

Extending outwardly from front portions of the opposite side walls 70,72 are a pair of mounting tabs 92 each having a circular aperture therein. Referring now to FIGS. 2 and 9, to operatively mount the socket structure 50 on the interior side of the housing wall structure 10 over the lens receiving opening 40, the front end 66 of the socket structure is outwardly inserted through the housing wall opening 18 to bring it into engagement with the inner side of the exterior trim strip 20 around the lens opening 40. As this is done, the outer ends of the trim strip pins 30,32 rearwardly enter the apertures in the socket structure mounting tabs 92 (see FIGS. 5 and 6). To complete the mounting of the socket structure 50, the outer ends of the trim strip pins 30,32 are heat staked within the mounting tab apertures.

With the mounting socket structure 50 secured to the housing wall structure 10 in this manner, the lens member 48 is installed by simply pushing it forwardly through the socket structure interior until the lens reaches an operating position thereof (see FIG. 9) in which the front end portion 52 of the lens is outwardly received in the trim strip lens opening 40. As the lens member forwardly approaches this operating position, the lens mounting pin portion 62 engages the socket outer side wall section 86 and outwardly deflects it to its dotted line position shown in FIG. 9.

When the lens forwardly reaches its operating position, an inner end portion of the pin enters the arcuate wall section recess 84 (see FIG. 5), and the deflected wall section 86 snaps back to its solid line position in which an outer end portion of the pin 62 is received in the arcuate end recess 90 of the wall section 86 (see FIG. 5), thereby lockingly engaging the pin 62. As can be seen in FIG. 9, a front section of the lens member 48 behind the front end portion 52 of the lens is closely received and laterally supported within a front end portion of the socket structure interior, the rear end portion 56 of the lens member is upwardly offset into adjacency with the underside of the side wall section 86, and the rear end face 60 of the lens member is forwardly offset relative to the open rear end 60 of the mounting socket structure 50.

The LED device 46 is then supported behind, and in a facing relationship with, the rear end face 60 of the mounted lens member 48, with the front side of the LED device 46 being generally flush with the open rear end 68 of the mounting socket structure 50. To support the LED device 46 in this position, it may be conveniently surface mounted on a printed circuit board 94 shown in phantom in FIG. 9. Circuit board 94 is appropriately connected to the power supply circuit P (FIG. 1), as schematically indicated by lead 96, to energize the LED when the power supply circuit is activated. When the LED device 46 is energized, it beams light onto the rear end face 60 of the lens member 48. The received light is passed longitudinally through the lens, along an internal light transmission path laterally bounded by the peripheral side surface of the lens, to the front end face 54 of the lens to illuminate such front end face, thereby providing a visual indication that the power supply circuit P is activated.

According to an important aspect of the present invention, there is no lens support structure that laterally encroaches upon this light transmission path to and through the lens member 48. Specifically, it can be seen that no lens support structure is interposed between the light-receiving rear end face 60 of the lens and the front side of the LED device 46—all of the illustrated lens support structure is disposed laterally outwardly of the mounted lens. Accordingly, the entire front end face 54 of the lens may be illuminated without the dark spots formed thereon by conventional lens support apparatus that extends laterally across the back end of the lens structure.

It can additionally be seen that the actual operative placement of the lens member 48 on the interior side of the housing wall structure 10 does not require that the lens be glued or sonically welded to the housing wall structure as it would be under conventional lens mounting practice. All that is necessary is to simply push the lens into the socket structure until it latchingly snaps into place therein. This feature of the present invention advantageously reduces the lens installation time and simplifies lens installation.

Referring now to FIGS. 2,7,8 and 10, the multiple light assembly 44 includes a molded plastic mounting socket structure 100, a top row of four molded plastic lens members **48*a*, a bottom row of four molded plastic lens members 48*b*, a top row of four LED devices 46*a*, and a bottom row of four LED devices 46*b*. Each of the lens members 48*a*,48*b* is identical in construction and configuration to the previously described lens member 48. The LED devices 46*a*,46*b* are representatively surface mounted on a printed circuit board 102 shown in phantom in FIG. 10**.

The disk drives A–D (FIG. 1) are operatively connected to the circuit board 102 by the schematically depicted leads 104 and are associated with the four upper lenses **48*a*, and the disk drives E–H are operatively connected to the circuit board 102 by the schematically depicted leads 106 and are associated with the four lower lenses 48*b***.

The mounting socket structure 100 (FIGS. 7,8 and 10) has an open front end 108, an open rear end 110, a pair of opposite side walls 112 and 114, a pair of horizontal top and bottom front outer side wall portions 116 and 118, an upwardly and rearwardly sloped top rear outer side wall portion 120, and a downwardly and rearwardly sloped bottom rear outer side wall portion 122. Interior horizontal and vertical walls 124,126 divide the interior of the socket structure 100 into a top row of four cavities 128 operative to receive the top row of lens members **48*a*, and a bottom row of four cavities 130 operative to receive the bottom row of lens members 48*b*. The interior of each of the eight cavities 128,130 has a configuration identical to that of the interior of the previously described mounting socket structure 50**.

The top sides of the upper cavities 128 are partially bounded by separated top side wall sections **80*a* and 86*a* which are identical in configuration and operation to the previously described side wall sections 80,86 of the socket structure 50 and have outer ends with arcuate recesses 84,90 respectively formed therein. The bottom sides of the lower cavities 130 are partially bounded by separated bottom side wall sections 80*b* and 86*b* which are also identical in configuration and operation to the previously described side wall sections 80,86 of the socket structure 50 and have outer ends with arcuate recesses 84,90** respectively formed therein.

To mount the multiple lens socket structure 100 on the interior side of the wall structure 10, the front end 108 of the socket structure 100 is extended outwardly through the housing wall opening 16 (FIG. 2) to bring it into abutment with the inner side of the trim strip 20, with the front ends of the cavities 128 positioned over the lens openings 36 and the front ends of the cavities 130 positioned over the lens openings 38. As the socket structure 100 is moved to this position, the trim strip pins 24,26 rearwardly enter apertures formed in a pair of mounting tabs 132,134 extending outwardly from opposite sides of a front portion of the mounting socket structure 100 (see FIGS. 7 and 8). The pins 24,26 are then heat staked in place within the mounting tab apertures to complete the mounting of the socket structure 100 on the housing wall structure 10.

Figure 10:
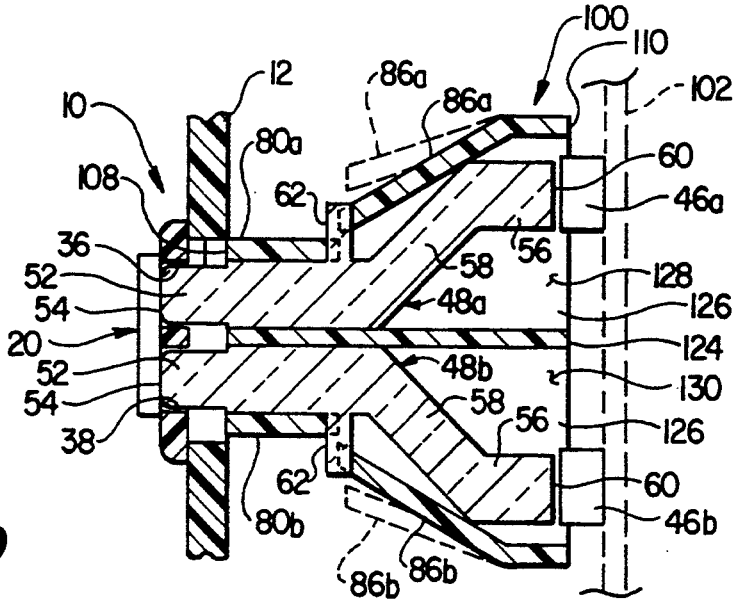
FIG. 10 is an enlarged scale cross-sectional view, taken along line 10—10 of FIG. 2, through the multiple lens LED indicating light assembly illustrating it in an assembled state.

The lens members 48*a*, with their mounting pins 62 extending upwardly, are pushed forwardly into the cavities 128 to operating positions in which their front end portions 52 are received in the lens openings 36 and their mounting pins 62 are lockingly engaged by the latch wall pairs 80*a*,86*a* as shown in FIG. 10. In a similar manner, the lens members 48*b*, with their mounting pins 62 extending downwardly, are pushed forwardly into the cavities 130 to operating positions in which their front end portions 52 are received in the lens openings 38 and their mounting pins 62 are lockingly engaged by the latch wall pairs 80*b*,86*b* as shown in FIG. 10. It will be readily appreciated that each of the latch wall pairs 80*a*,86*a* and 80*b*,86*b* operate in the same manner as their counterpart latch wall pair 80,86 in the previously described mounting socket structure 50.

After the lens members 48*a*,48*b* are operatively inserted in their associated socket cavities 128 and 130, the circuit board 102 is suitably supported behind the mounting socket structure 100 (FIG. 10) to position the upper LED devices 46*a* in a facing relationship with the rear end surfaces 60 of the upper lens members 48*a*, and the front faces of the LED devices 46*a* generally flush with the rear end surface of the mounting socket structure 100, and position the lower LED devices 46*b* in a facing relationship with the rear end surfaces 60 of the lower lens members 48*b*, with the front faces of the LED devices 48*b* generally flush with the rear end surface of the mounting socket structure 100.

With respect to each of the lenses 48*a*,48*b* the mounting socket structure 100 provides the same advantages that the single lens mounting socket structure 50 provides for the lens member 48. Additionally, the rear wall sections of the socket structure automatically define around the rear end of each of the cavities 128,130 light shields that prevent the light forwardly emitted from any of the LED devices 46*a*,46*b* from undesirably illuminating any of the lenses except the lens positioned directly forwardly of the LED device. Moreover, the overall configuration of the lenses 48*a*,48*b* and the socket structure 100 advantageously permits the front end portions 52 of such lenses to be very closely grouped on the housing wall structure 10. Further, the opposite rear end offsets in the upper lenses 48*a* and lower lenses 48*b* provide additional rear mounting room for the upper and lower LED devices 46*a* and 46*b*.

The foregoing detailed description is to be clearly understood as being given by way of illustration and example only, the spirit and scope of the present invention being limited solely by the appended claims.

What is claimed is:

1. An LED indicating light lens comprising:

an elongated body having an inlet end face for receiving light from an LED device positioned adjacent thereto, an outlet end face spaced apart from said inlet end face, an outer peripheral side surface extending between said inlet and outlet end faces, said elongated body being adapted to transmit received LED device light from said inlet end face to said outlet end face through an internal light transmission path externally bounded by said outer peripheral side surface, said elongated body having, along its length, a generally doglegged configuration defined by a front end portion centered about a first axis passing through said outlet end face, a rear end portion laterally offset from and generally parallel to said front end portion and centered about a second axis extending through said inlet end face and laterally offset from and generally parallel to said first axis, and a bent longitudinally intermediate portion joining said front and rear end portions and being centered about a third axis that is angled relative to said first and second axes; and a mounting pin portion positioned on said front end portion of said elongated body and projecting transversely outwardly from said peripheral side surface.

2. The LED indicating light lens of claim 1 wherein: said elongated body and said mounting pin portion are integrally molded from a plastic material.

3. The LED indicating light lens of claim 1 wherein: said elongated body has a front end portion having a generally oval cross-section, with the balance of said elongated body having a generally rectangular cross-section along its length.

4. The LED indicating light lens of claim 1 wherein: said elongated body has a rear end portion tapering rearwardly and laterally inwardly to said inlet end face of said elongated body.

5. The LED indicating light lens of claim 4 wherein: said inlet end face is essentially planar and has a generally square configuration.

6. Indicating light apparatus mountable on a housing wall structure having a closely grouped plurality of lens receiving openings extending outwardly therethrough, said indicating light apparatus comprising:

a plurality of lens members each having an elongated body that has, along its length, a generally doglegged configuration defined by a front end portion having a front end surface and being centered about a first axis passing through said front end surface, a rear end portion laterally offset from and generally parallel to said front end portion, said rear end portion having a rear end surface and being centered about a second axis extending through said rear end surface and laterally offset from and generally parallel to said first axis, a bent longitudinally intermediate portion joining said front and rear end portions and being centered about a third axis that is angled relative to said first and second axes, said front end portion outwardly insertable into one of said lens openings, said rear end portion positionable in a facing relationship with an LED device to receive light therefrom, an outer peripheral side surface extending between said front and rear end portions, an internal light transmission path extending between said front and rear end portions and being laterally bounded by said outer peripheral side surface, and a mounting projection positioned intermediate said front and rear end portions and extending outwardly from said outer peripheral side surface:

mounting socket means for supporting said lens members in operating positions in which said front end portions thereof are disposed within said lens receiving openings of said housing wall structure, said mounting socket means having an open front end securable to the interior side of said housing wall structure over said lens receiving openings, an open rear end, interior wall means for dividing the interior of said mounting socket means into a plurality of generally parallel cavities, opening outwardly through said front and rear ends of said mounting socket means and having outer side wall portions, through which said lens members may be forwardly inserted and moved through said cavities to said operating positions, and resilient latch means formed by said outer side wall portions, said resilient latch means being operative to be deflected by and then lockingly engage said mounting projections in response to forward movement of said lens members through said cavities to said operating positions; and means for securing said open front end portion of said mounting socket means on the interior side of said housing wall structure over said lens receiving openings;

each of said mounting projections having a generally pin-like configuration, longitudinally projecting outwardly from the peripheral side surface of its associated lens member intermediate the front and rear end portions therefor, and having an outer end portion, each of said outer side wall portions of said mounting socket means having a first side wall section extending rearwardly from adjacent said open front end of said mounting socket means and having a rear end with a depression therein configured to receive a first portion of the outer end portion of one of said mounting projections, and a resiliently deflectable second side wall section extending forwardly from adjacent said open reef end of said mounting socket means and having a front end with a depression therein configured to receive a second portion of the outer end portion of said one of said mounting projections, said mounting socket means being configured in a manner such that each of said cavities has a rear end portion laterally enlarged relative to a front end portion thereof and bounded on one side by one of said outer side wall portions, and each of said outer side wall portions, each of said resiliently deflectable second side wall sections being sloped forwardly and inwardly, each of said second side wall sections being positioned opposite another of said second side wall sections with a pair of said rear cavity end portions being disposed therebetween, and each lens member rear end portion and its associated front end portion being positioned to be received within the enlarged rear end portion of its associated cavity, adjacent the second side wall section partially bounding the cavity, when said mounting projections are lockingly engaged by said resilient latch means.

7. The indicating light apparatus of claim 6 wherein:

each of said lens members is molded from a plastic material.

8. The indicating light apparatus of claim 7 wherein:

each of said mounting projections has a pin-like configuration and longitudinally projects outwardly from the outer peripheral side surface of its associated lens member at a position thereon intermediate the front and rear end portions of the lens member.

9. The indicating light apparatus of claim 6 wherein:

said mounting socket means have a rear end surface, and said rear end portions of said lens members are disposed forwardly of said rear end surface when said lens member mounting projections are lockingly engaged by said resilient latch means.

10. The indicating light apparatus of claim 6 wherein said means for securing include:

a pair of mounting tabs projecting outwardly from opposite sides of said front end of said mounting socket means and having apertures extending therethrough, and a pair of mounting pin members projecting inwardly from said housing wall structure, said mounting pin members being receivable and securable within said mounting tab apertures to operatively hold said mounting socket means in place on said housing wall structure.

* * * * *